US005121816A

United States Patent [19]

Curtin

[11] Patent Number: 5,121,816

[45] Date of Patent: Jun. 16, 1992

[54] LIFT SAFETY SYSTEM

[75] Inventor: Richard M. Curtin, Redmond, Wash.

[73] Assignee: Genie Industries, Inc., Redmond, Wash.

[21] Appl. No.: 589,927

[22] Filed: Sep. 28, 1990

[51] Int. Cl.[5] ..... B66B 9/20

[52] U.S. Cl. ..... 187/9 R; 280/766.1

[58] Field of Search ..... 187/9 E, 9 R, 105; 280/766.1, 765.1; 212/189, 145, 144

[56] References Cited

U.S. PATENT DOCUMENTS

| | | | |
|---|---|---|---|
| 4,084,777 | 4/1978 | Lambert | 280/766.1 |
| 4,860,539 | 8/1989 | Parrett et al. | 280/766.1 |
| 4,921,392 | 5/1990 | Wagner | 280/766.1 |

*Primary Examiner*—Robert P. Olszewski
*Assistant Examiner*—Kenneth Noland
*Attorney, Agent, or Firm*—Seed and Berry

[57] ABSTRACT

A portable multi-stage lift is provided with multiple outriggers for stability. The lift cannot be raised unless the outriggers are positioned in a fully extended, load-bearing relationship with the lift.

3 Claims, 5 Drawing Sheets

LIFT SAFETY SYSTEM

TECHNICAL FIELD

The present invention relates to a safety system for multistage portable lifts of the type having extensible outriggers necessary for adequate support when a work platform mounted on the lift is elevated.

BACKGROUND OF THE INVENTION

It is often convenient for construction and repair service work that materials, equipment and personnel be raised at a work site to elevations in the range of 30 to 40 feet by use of a portable lift that can be wheeled when lowered through doorways, and can be easily transported. For stability when elevated, it is essential that such lifts have outriggers, and it is preferred that the outriggers be easy to move between active and stowed positions. It is also preferred that the outriggers have an arrangement permitting the work platform of the lift to be positioned close to walls and corners. Lifts of this general type are disclosed in U.S. Pat. Nos. 4,015,686 and 4,458,785, for example.

Commonly, such lifts have a mast extension system operated by extension of a hydraulic cylinder which is supplied with pressurized fluid by a pump powered by an electric motor, and having its suction connected to a reservoir tank. The pump, motor, and tank are mounted on the frame of the lift, and suitable controls are provided so that the work platform can be raised and lowered by a person occupying the work platform or at ground level.

However, a need exists for a safety system which prevents raising the work platform unless the outriggers are fully extended and properly positioned in a load bearing condition.

SUMMARY OF THE INVENTION

In accordance with the present invention, a special control system is provided for the electric motor used to drive the pump supplying pressurized fluid to the hydraulic cylinder in the mast extension system. Disablement of this control system prevents extension of the mast.

In its preferred embodiment, the control system is disabled whenever the outriggers are not in proper supporting position. Normally open switches are provided in a circuit for the control system. These switches are arranged to be closed by engagement with the outriggers when the outriggers are properly extended. Unless all of these switches are closed, the circuit is disabled, thereby shutting down the source of pressurized fluid for raising the mast.

In the preferred embodiment, the outriggers are slidably mounted in horizontal sleeves and have vertically adjustable jack screws at their outer ends which are engaged by quick-release nut segments. When the outriggers are in their extended positions, they are free to rock upwardly in a narrow range responsive to operation of the jack screws into load-carrying ground engagement taking the load of the lift from its transport wheels. The previously mentioned switches in the circuit are mounted within the sleeves and are arranged to be closed by the outriggers when they rock upwardly. This permits the control circuit to then be activated whenever a manual switches on the work platform are closed by the operator.

DETAILED DESCRIPTION OF THE INVENTION

Figure 1:
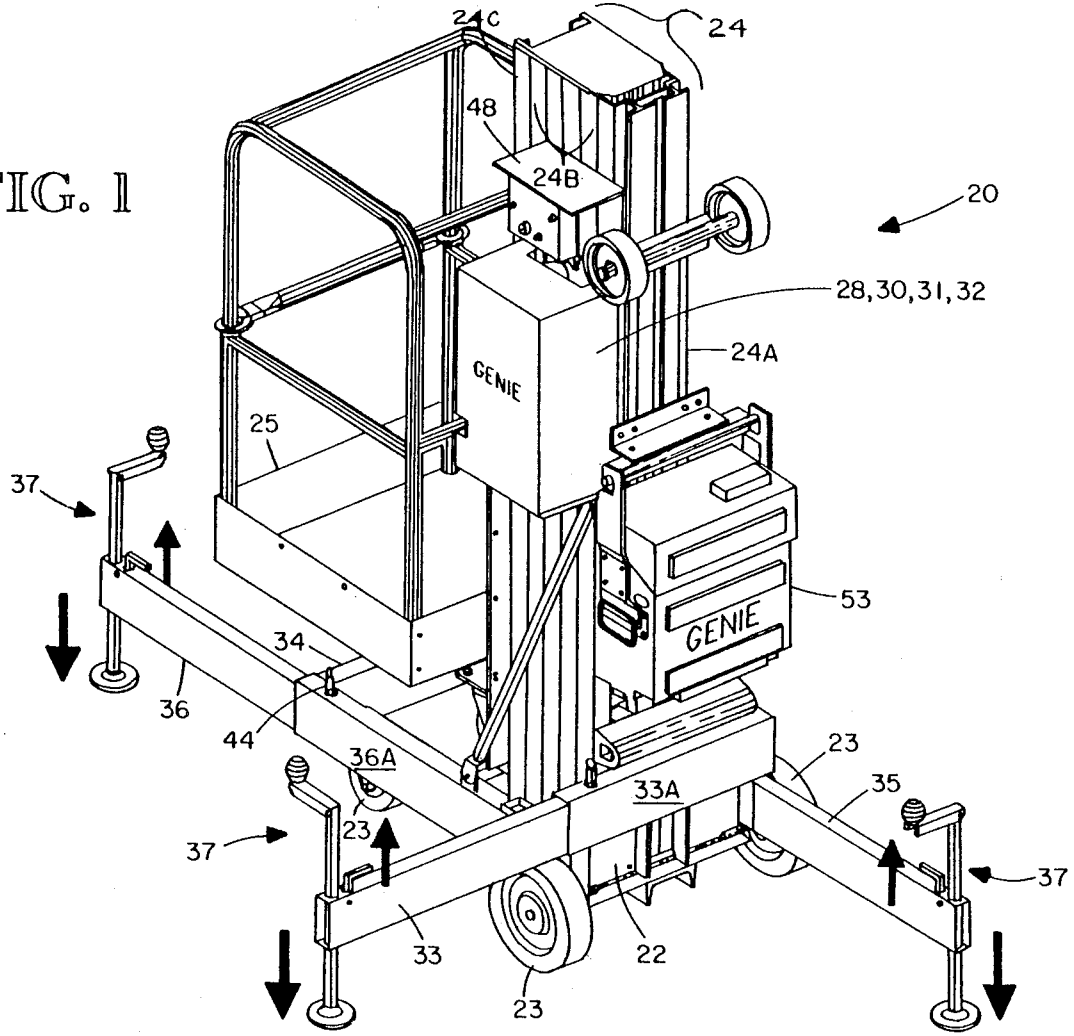
FIG. 1 is a front isometric view of a portable lift employing a safety system of the present invention.
Figure 2:
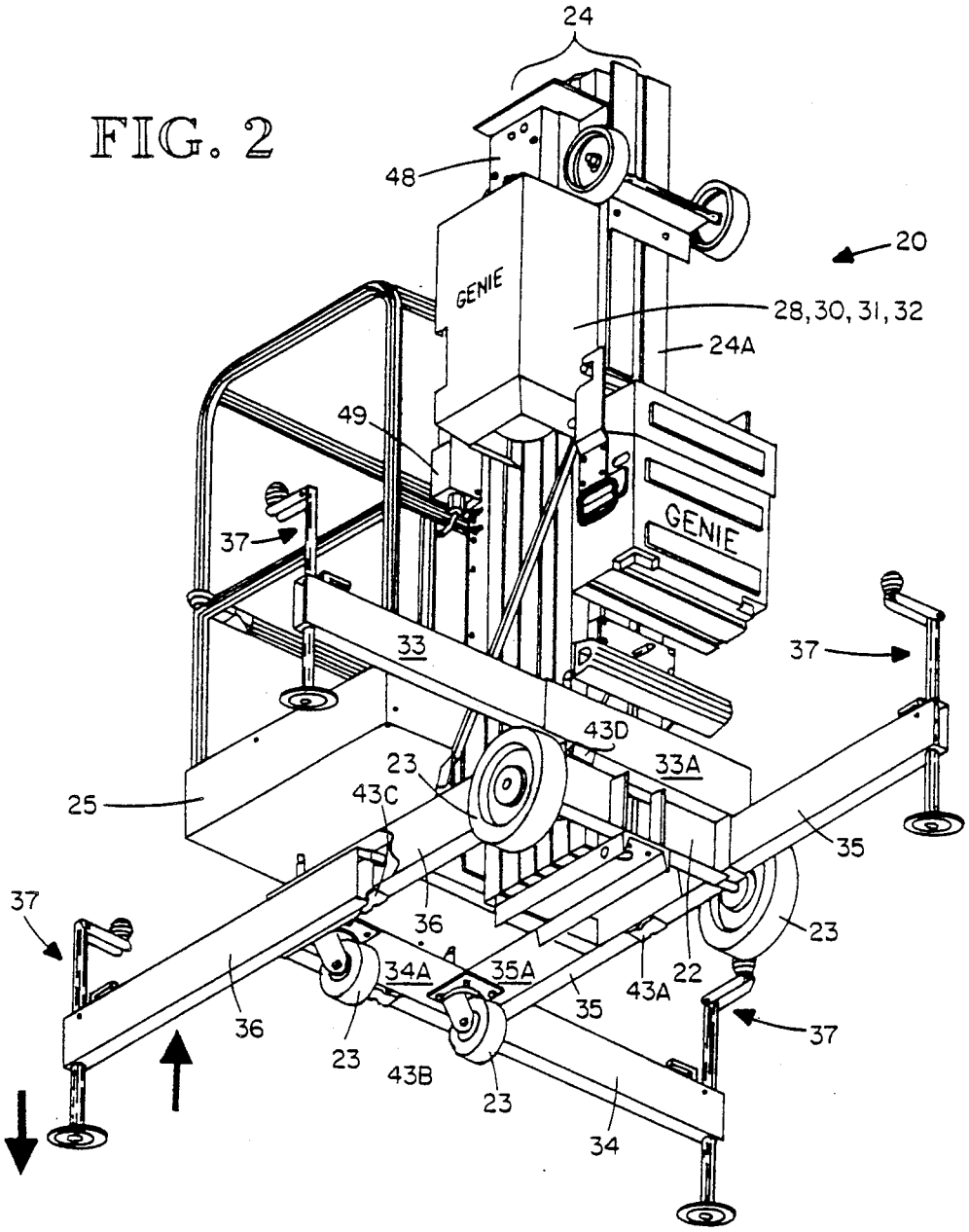
FIG. 2 is a second isometric view of the portable lift of FIG. 1.

Referring to FIG. 1 and 2, the lift 20 has a base frame 22 with wheels 23 on which is mounted an extensible mast 24 for lifting a work platform 25. The mast 24 may be of the type shown in U.S. Pat. No. 4,458,785. the disclosure of which is herein incorporated by reference in which (referring to FIGS. 1 and 2 of this disclosure) a stationary base stage **24*a* is rigidly mounted on the base frame 22, and one or more intermediate telescopic stages 24*b* and a top stage 24*c* are mounted forwardly of the base stage. A load platform 25** is slidably mounted at the front of the top stage.

The lowest of the intermediate stages is extended and retracted by action of a double-acting cylinder 26 (see FIG. 6) unit in the conventional manner, and the remaining stages and the load platform are responsive to extension of the cylinder unit by way of a chain and pulley system (also commonly known as a reeving system). Systems of this type are well known to those of ordinary skill in the art and are commonly used with three stage fork lift vehicles. The pressured fluid for the cylinder unit is supplied by a pump 28 driven by an electric motor 30. Fluid from a reservoir tank 31 is circulated by the pump 28 to the cylinder unit 26 via a control valve system 32 which also controls the dumping of fluid from the cylinder unit to the reservoir tank when it is desired to retract the cylinder unit to lower the work platform. A suitable control valve system 32, pump 28, motor 30, and reservoir 31 can be obtained from Fenner Fluid Power Company, Rockford, Ill.

Figure 5:
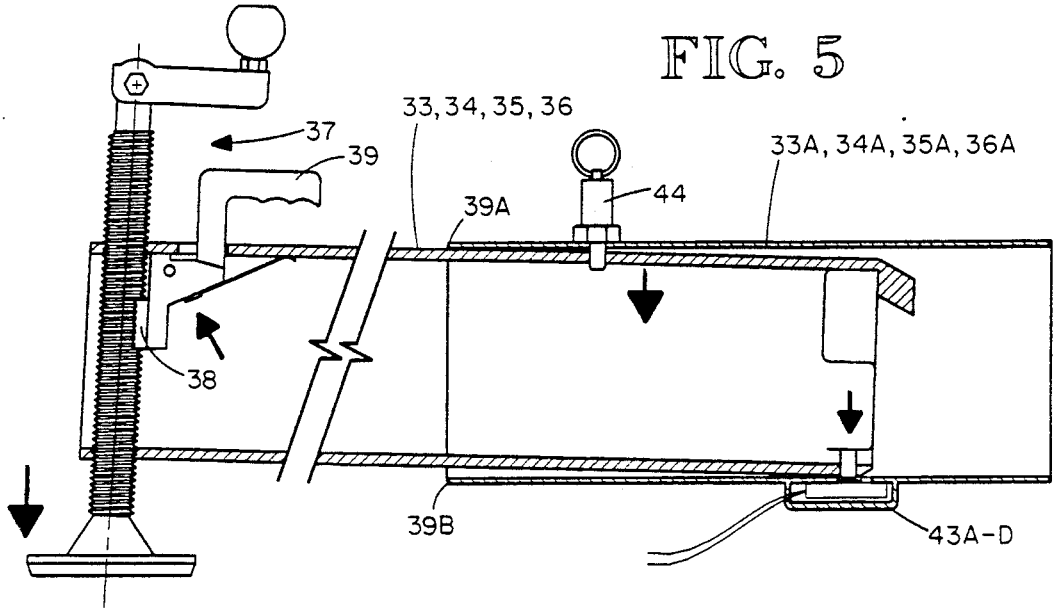
FIG. 5 is a sectional, side elevational view of the outrigger switch mechanism in an extended, load bearing position.
Figure 4:
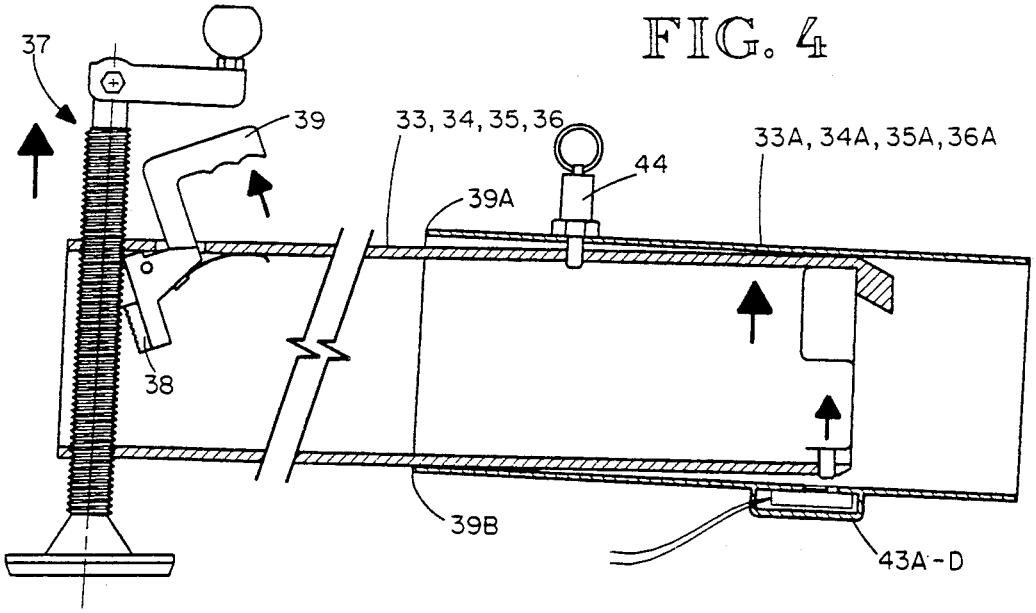
FIG. 4 is a sectional, side elevational view of an outrigger switch mechanism with the outrigger in an extended, non-load bearing position.

The lift 20 is provided with horizontally extending front and back outriggers 33, 34 arranged to extend right and left, and longitudinal outriggers 35, 36 arranged to extend front and back for stabilization of the lift. These outriggers are slidably mounted in respective sleeves **33*a*—36*a* comprising part of the base frame 22. The outriggers have respective screw jacks 37 mounted adjacent their outer ends for leveling the base frame 22 and outriggers as a unit and to take the load from the wheels 23. As shown in FIGS. 4 and 5, the screw jacks are engaged by quick-release nut segments 38 pivotally connected to each outrigger 33–36 and operated by spring loaded levers 39**.

The vertical tolerance between the outriggers 33–36 and the inside of the sleeves **33*a*–36*a* is purposely selected to be large enough so that the outriggers can rock vertically relative to the upper end 39*a* and lower end 39*b* of the sleeves in a narrow range when the outriggers are in the extended position, as shown in FIGS. 4 and 5. Accordingly, when the screw jacks 37 are turned to move downwardly by handles 32*a* into ground engagement to take a load as shown in FIG. 5, the outriggers responsively rock upwardly about upper end 39***a* to a limited degree. In accordance with this invention, normally-open outrigger operated switches 43*a–d* are positioned in the sleeves such as to be closed by engagement with the outriggers only when the outriggers 33–36 are extended and rocked upwardly by operation of the four screw jacks 37 to take the load of the lift. The switches 43*a–d* are part of a control circuit to be later described.

A control panel 48 is mounted on the stationary base section of the lift, and a control box 49 (shown schematically in FIG. 3) is mounted on the work platform 25.

Figure 3:
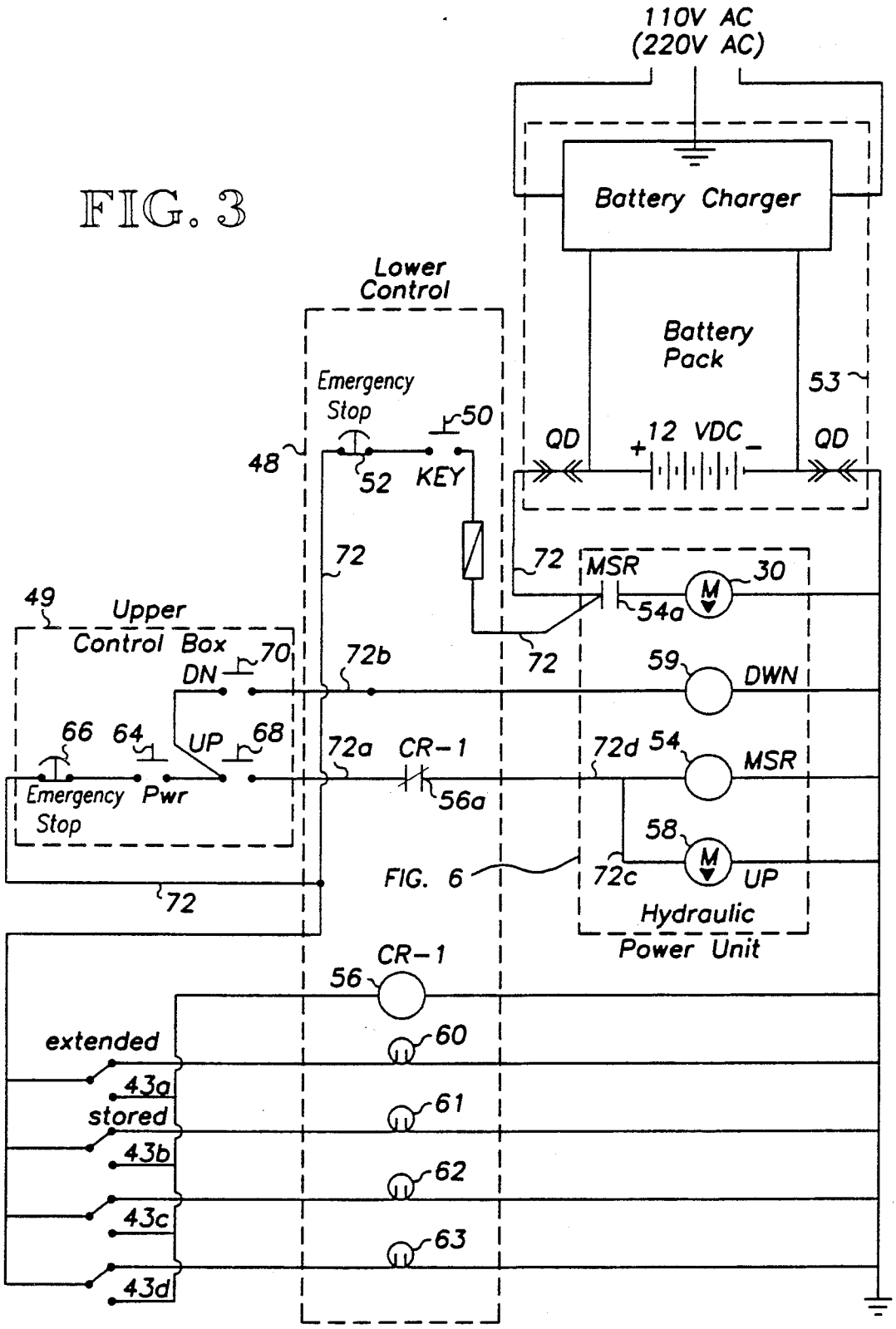
FIG. 3 is a circuit diagram of a safety system circuit.

As shown in the circuit diagram of FIG. 3, the control panel 48 contains a key-operated switch 50, and an emergency push-button stop switch 52 in series for controlling power from a 12 volt source 53. This circuit also includes a motor start relay coil 54 for operating a normally open motor relay 54*a*, an outrigger relay 56 for opening a normally closed safety relay 56*a*, an "up" solenoid 58 for operating a normally open hydraulic feed valve 58*b* (see FIG. 6) for the double-acting hydraulic cylinder 26, a "down" solenoid 59 for operating a normally closed hydraulic return valve 59*a*, and four green indicator lamps 60–63.

The control box 49 moves up and down with the platform 25 and contains a power switch 64, an emergency stop push-button switch 66, an "up" switch 68, and a "down" switch 70. A flexible cable (not shown) connects the control panel 48 and control box 49 and contains positive lead 72 and branch leads 72*a* and 72*b*. Within the control panel 48 the branch lead 72*a* contains the safety relay 56*a* and then divides to provide a lead 72*c* for the "up" solenoid 58 and a lead 72*d* for the coil 54 of the motor relay 54*a*. Lead 72*b* continues to the "down" solenoid 59. The outrigger relay coil 56 in the control panel 48 has parallel branch leads each connecting to a respective "stowed" pole of the outrigger operated switches a–d, and each indicator lamp 60–63 is contained in parallel leads connected to the "extended" poles of each respective outrigger switch.

The control system of FIG. 3 operates by preventing energization of the motor 30 and operation of the "up" valve 58*c* (and thus raising of the mast 24) unless all of the outriggers 33–36 are fully extended into a load bearing position as shown in FIG. 5.

Figure 6:
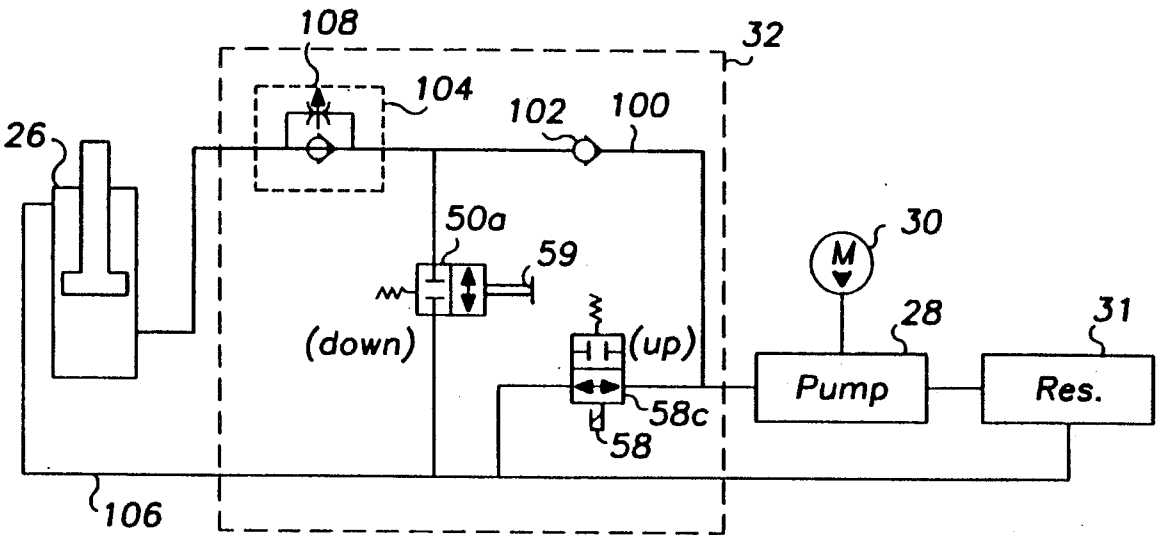
FIG. 6 is a schematic representation of a hydraulic system controlled by the circuit of FIG. 3.

It will be understood that closing of the keyswitch 50 is necessary to power the control circuit. The procedure for raising and lowering the lift is described as follows. To raise the lift, all of the outriggers must be fully extended into a load bearing position as shown in FIG. 5. All of the outrigger operated switches 43*a–d* are therefore closed as shown in FIG. 3 and as evidenced by energizing of the four indicator lamps 60–63. The outrigger relay coil 56 thus remains de-energized, thereby leaving the normally closed motor relay 56*a* closed and making it possible to energize the motor relay 54 by closing the power switch 64 and "up" switch 68. As shown in FIGS. 3 and 6, when safety relay 56*a* is closed by having the outriggers in the extended position, the "up" solenoid 58 is energized and normally-open "up" valve 58*c* is moved to a closed position, thereby allowing fluid in high pressure line 100 to be pressurized by the pump 28. Fluid will therefore flow through check valve 102 and fluid control valve 104 to the extending side of double acting cylinder 26. Fluid from the retracting side of the cylinder is relieved by way of fluid relief line 106 to the reservoir 31. Note that fluid can not flow from high pressure line 100 to relief line 106 through normally closed "down" valve 59*a* because "down" solenoid 59 has not been energized. The operator on the working platform controls this action by holding the power switch 64 and "up" switch 68 in closed positions to energize the pump motor relay 54 and thereby start the motor to lift the platform by extension of the hydraulic cylinder unit. As soon as closing pressure is released on the switches 64, 68 they open, and hence the pump motor stops and the valve 58 opens, thereby stopping elevation of the work platform. Note that whenever any one of the outrigger operated switches 43*a–d* are closed in the stowed positions (when any one of the outriggers are not in a load bearing position as shown in FIG. 5), the outrigger coil 56 is energized and the safety relay 56*a* is in the open position. The motor relay coil 54, and thus the motor 30, cannot be energized. In addition, the "up" solenoid 58 remains de-energized, maintaining a fluid path between the pump 28 and the reservoir 31. This prevents the pump from pressurizing the high pressure line 100. In this manner, the system is "fail safe" because the switches 43*a–d* cannot enter the state shown in FIG. 3 until the outriggers are fully extended into load bearing positions.

When the operator on the working platform desires to lower it, he pushes closed the power switch 64 and the "down" switch 70, thereby energizing the "down" solenoid 59 to cause fluid to return from the cylinder unit to the reservoir tank by way of restrictor 108 in fluid control valve 104. Note that this can be done regardless of the state of switches 43*a–d*. At all times a person at ground level can push open the emergency switch 52 and de-energize the entire circuit. Then the work platform can be lowered by manually opening "down" valve 59 which can be easily reached at ground level.

The indicator lamps can be arranged on the face of the control panel 48 in a generally rectangular pattern simulating the relative positions of the four outriggers. Hence, if one of the indicator lamps does not light, the operator can immediately determine which outrigger is not in fully extended operating position.

I claim:

1. A lift comprising:

a base frame having wheels;

an extensible mast mounted on said frame;

extension means for extending and retracting said mast;

outrigger arms each slidably mounted on said frame for generally horizontal between a retracted position and an extended position, each arm also being free to rock vertically within a narrow range when in said extended position;

a respective vertically adjustable jack mounted on each outrigger arm for load-carrying ground engagement when the arm is in said extended position whereby the base frame is lifted such as to take load from said wheels when the jacks are loaded; and disabling means arranged to be operated by engagement with said outrigger arms during rocking thereof in said narrow range, said disabling means being operatively associated with said extension means for disabling said extension means when said jacks are not loaded;

said disabling means comprising an electric control circuit for said extension means containing a respective normally open switch sleeves mounted on said base frame, and said switches and outriggers are arranged such that the outriggers pivot upwardly and close said switches when the outriggers are in extended position and said jacks are in load-carrying ground engagement.

2. A lift comprising:

a multistage mast having a base frame with front and back ends, a stationary mast stage mounted on the base frame, movable mast stages forwardly of the stationary mast stage and including a top stage at the front of the mast, and a work platform at the front of the top stage;

elevating means for extending the mast and raising the work platform responsive to operation of an electric motor;

outriggers slidably mounted on said base frame between retracted and extended positions, said outriggers having vertically adjustable jacks at their outer ends arranged for load-carrying ground engagement when the outriggers are in extended position; and a control circuit for said electric motor including a respective normally-open switch for each outrigger arranged to be closed only when the respective outrigger is in extended position with its jack in load-carrying ground engagement, said switches being arranged in said control circuit such that said electric motor can be operated only when all of said switches are closed.

3. A lift according to claim 2 in which said outriggers are slidably mounted in generally horizontal sleeves mounted on said base frame, and said switches and outriggers are arranged such that the outriggers pivot upwardly and close said switches when the outriggers are in extended position and said jacks are in load-carrying ground engagement.

* * * * *

UNITED STATES PATENT AND TRADEMARK OFFICE

CERTIFICATE OF CORRECTION

PATENT NO. : 5,121,816

DATED : June 16, 1992

INVENTOR(S) : Richard M. Curtin

It is certified that error appears in the above-identified patent and that said Letters Patent is hereby corrected as shown below:

Title page, item [19], "Curtin" should read --Curtin, et al--

Title page, item [75], add --Willibald Neubauer, Seattle, Wash.--

Signed and Sealed this

Third Day of August, 1993

*Attest:*

Michael K. Kirk

MICHAEL K. KIRK

*Attesting Officer*

*Acting Commissioner of Patents and Trademarks*